US008502745B2

(12) United States Patent
Park et al.

(10) Patent No.: US 8,502,745 B2
(45) Date of Patent: Aug. 6, 2013

(54) ANTENNA APPARATUS

(75) Inventors: Se Hyun Park, Suwon-si (KR); Byung Tae Yoon, Suwon-si (KR); Dong-Jin Kim, Seoul (KR); Seong-Ook Park, Daejeon (KR); Rashid A. Bhatti, Daejeon (KR); Viet Anh Nguyen, Daejeon (KR); Mingoo Choi, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 877 days.

(21) Appl. No.: 12/371,684

(22) Filed: Feb. 16, 2009

(65) Prior Publication Data

US 2010/0045557 A1 Feb. 25, 2010

(30) Foreign Application Priority Data

Aug. 19, 2008 (KR) ..... 10-2008-0081019

(51) Int. Cl.
*H01Q 13/10* (2006.01)

(52) U.S. Cl.
USPC ..... 343/770; 343/893; 343/867; 343/850

(58) Field of Classification Search
USPC ..... 343/770, 876, 893, 850
See application file for complete search history.

(56) References Cited

U.S. PATENT DOCUMENTS

| | | | | |
|---|---|---|---|---|
| 7,557,765 | B2 * | 7/2009 | Lai et al. | 343/770 |
| 2003/0011519 | A1 * | 1/2003 | Breglia et al. | 343/700 MS |
| 2003/0030588 | A1 | 2/2003 | Kalis et al. | |
| 2004/0130494 | A1 * | 7/2004 | Fukushima et al. | 343/702 |
| 2005/0093753 | A1 * | 5/2005 | Masaki | 343/702 |
| 2007/0035463 | A1 * | 2/2007 | Hirabayashi | 343/824 |
| 2007/0123181 | A1 * | 5/2007 | Bit-Babik et al. | 455/101 |
| 2007/0285322 | A1 * | 12/2007 | Nyshadham et al. | 343/703 |
| 2008/0139136 | A1 | 6/2008 | Shtrom et al. | |

FOREIGN PATENT DOCUMENTS

| | | |
|---|---|---|
| JP | 1993-152830 | 6/1993 |
| JP | 2006-340234 | 12/2006 |
| JP | 2006-340235 | 12/2006 |
| KP | 10-2008-0006427 | 1/2008 |
| KR | 10-2005-0098896 | 10/2005 |
| KR | 10-2008-047874 | 5/2008 |
| WO | WO 2004/015810 A1 | 2/2004 |

OTHER PUBLICATIONS

European Search Report issued Apr. 21, 2009 in counterpart European Patent Application No. 03153557.5 (6 pages, in English).

* cited by examiner

*Primary Examiner* — Dieu H Duong
(74) *Attorney, Agent, or Firm* — NSIP Law

(57) ABSTRACT

An antenna apparatus that may be adapted to various environments. The antenna apparatus includes a radiation unit to transmit and receive in a 360° radius including a plurality of radiators, each radiator configured to radiate a main emission pattern in different direction; and a switch unit configured to selectively operate each of the plurality of radiators.

19 Claims, 6 Drawing Sheets

ANTENNA APPARATUS

CROSS-REFERENCE TO RELATED APPLICATION

This application claims the benefit under 35 U.S.C. §119 (a) of a Korean Patent Application No. 10-2008-0081019, filed on Aug. 19, 2008, in the Korean Intellectual Property Office, the disclosure of which is incorporated herein by reference in its entirety.

BACKGROUND

1. Field

The following description relates to an antenna apparatus. More particularly, the description relates to an antenna apparatus with a reconfigurable radiation pattern for various environments.

2. Description of Related Art

Demands for a high quality multimedia service using a wireless mobile communication technology are rapidly increasing. Wireless communication technology capable of transmitting and receiving information faster, while generating less error, also is in demand. In the accordance with such wireless communication technology, a proposed Multiple Input Multiple Output (MIMO) antenna has a plurality of multiple antenna elements uniquely arranged to perform operations with multiple inputs and outputs.

The MIMO antenna has the benefits of enhancing data transmission speed in a specific range, and of increasing a system range for a specific data transmission speed. For these reasons, MIMO antennas are used in a wide range of wireless devices and are primarily used in various wireless devices. In particular, MIMO antennas are used in portable mobile communication terminals. Consequently, there is a recent trend towards more compact MIMO antennas.

In addition, the radiation patterns of the plurality of antenna elements which configure the MIMO antennas are closely correlated with communication performance of the MIMO antenna system. Thus, research and development regarding the MIMO antenna with radiation patterns and capabilities to operate in diverse environments with various obstacles are constantly required.

SUMMARY

In one general aspect, an antenna apparatus includes a radiation unit to transmit and receive in a 360° radius including a plurality of radiators, each radiator configured to radiate a main emission pattern in a different direction; and a switch unit configured to selectively operate each of the plurality of radiators.

The plurality of radiators may be asymmetrically formed with respect to predetermined X and Y axes which are perpendicular with each other on a ground plane.

The antenna apparatus also may includes a substrate including a feeding layer in which the switch unit is pattern-formed; a dielectric layer formed on the feeding layer; and a ground layer formed on the dielectric layer, wherein each of the plurality of radiators include a slot formed by removal of a portion of the ground to expose the dielectric layer.

The radiation unit may include a first radiator including a slot configured along a straight line with a length of a ¼ wavelength of a transmission/reception radio wave, wherein the first radiator is configured to radiate a first main emission pattern; a second radiator including a slot configured along a direction perpendicular to the first radiator with a length of a ¼ wavelength of the transmission/reception radio wave, wherein the second radiator is configured to radiate a second main emission pattern that is perpendicular to the first main emission pattern; a third radiator including a slot twice bent including a first portion, a second portion, and a third portion, the first portion having a first and a second end configured along a line parallel to the length of the first radiator, the second portion formed at a first end of the first portion, perpendicular to the first portion and extending toward the first radiator, the third portion formed at the second end of the first portion, perpendicular to the first portion and extending toward the first radiator, the third radiator having a length of a ½ wavelength of the transmission/reception radio wave, and the third radiator configured to radiate a third main emission pattern which is perpendicular to the second main emission pattern; and a fourth radiator including a slot twice bent including a first portion, a second portion, and a third portion, the first portion having a first and a second end configured along a line parallel to the length of the second radiator, the second portion formed at a first end of the first portion, perpendicular to the first portion and extending toward the second radiator, the third portion formed at the second end of the first portion, perpendicular to the first portion and extending toward the second radiator, the fourth radiator having a length of a ½ wavelength of the transmission/reception radio wave and the fourth radiator configured to radiate a fourth main emission pattern which is perpendicular to the third main emission pattern.

The switch unit may include a main feeding line; four sub feeding lines, each sub feeding line configured to connect the main feeding line to a different one of the first, second, third, and fourth radiators; and four switches, each switch arranged between the main feeding line and a different one of the four sub feeding lines, and each configured to selectively enable its corresponding connection between the main feeding and an associated sub feeding line. The switch unit may also include a fifth switch provided on the main feeding line configured to enable signal transmission by a pair of the switches to be turned on/off.

Each of the feeding lines may include a connection unit connected with a respective switch; and an expansion unit extending from the connection unit, and perpendicular to a length of a respective one of the radiators.

The plurality of the radiation units and the switch units may be spaced apart from each other on the substrate.

In another general aspect, an antenna apparatus includes a radiation unit configured to selectively transmit and receives information including: a first radiator and a second radiator, each having a length of a ¼ wavelength of a transmission/reception radio wave, and a third radiator and a fourth radiator, each having a length of ½ wavelength of a transmission/reception radio wave; and a switch unit configured to selectively enable the first through fourth radiators to be turned on/off.

Each of the first through fourth radiators may be configured to radiate a main emission pattern that is perpendicular to the main emission patterns of adjacent radiators.

The switch unit may include a main feeding line; four sub feeding lines, each sub feeding line configured to connect the main feeding line to a different one of the first, second, third, and fourth radiators; and four switches, each switch arranged between the main feeding line and a different one of the four sub feeding lines, and each configured to selectively enable its corresponding connection between the main feeding and an associated sub feeding line. The switch unit also may include a fifth switch provided on the main feeding line configured to enable signal transmission by a pair of the switches to be turned on/off.

In yet another general aspect, an antenna apparatus includes a substrate; a plurality of radiation units spaced apart from each other on the substrate, each radiation unit including a plurality of radiators, each radiator configured to form a main emission pattern in a different direction; and a plurality of switch units to control the main emission pattern of the plurality of radiation units.

The plurality of radiation units may include a first radiator, a second radiator, a third radiator and a fourth radiator configured asymmetrically with respect to predetermined X and Y axes and perpendicular to each other on a ground plane of the substrate, wherein each main emission pattern is configured to radiate from a respective one of the radiators in a direction perpendicular to the main emission pattern of its adjacent radiators.

The first radiator and the second radiator each may extend along a straight line having a length of ¼ wavelength of a transmission/reception radio wave, and the third radiator and the fourth radiator each may include at least two bends forming generally a '⊏' shape with a length of ½ wavelength of the transmission/reception radio wave.

The switch unit may include a main feeding line; four sub feeding lines, each sub feeding line configured to connect the main feeding line to a different one of the first, second, third, and fourth radiators; and four switches, each switch arranged between the main feeding line and a different one of the four sub feeding lines, and each configured to selectively enable its corresponding connection between the main feeding and an associated sub feeding line. The switch unit also may include a fifth switch provided on the main feeding line configured to enable signal transmission by a pair of the switches to be turned on/off.

Each sub feeding lines may include a connection unit connected to an associated one of the switches; and an expansion unit configured to extend from the connection unit, and across a width of a respective one of the radiators.

The substrate is rectangular plate-shaped, and the plurality of radiation units and the switch units are spaced apart from each other on a corner of the substrate.

Other features and aspects will be apparent from the following description, the drawings, and the claims.

BRIEF DESCRIPTION OF THE DRAWINGS

Throughout the drawings and the detailed description, unless otherwise described, the same drawing reference numerals refer to the same elements, features, and structures. The size and scale of the elements may be exaggerated for clarity and convenience.

DETAILED DESCRIPTION

The following detailed description is provided to assist the reader in gaining a comprehensive understanding of the media, apparatuses, methods and systems described herein. Accordingly, various changes, modifications, and equivalents of the systems and methods described herein will be suggested to those of ordinary skill in the art. Also, descriptions of well-known functions and constructions may be omitted for clarity and conciseness.

Figure 1:
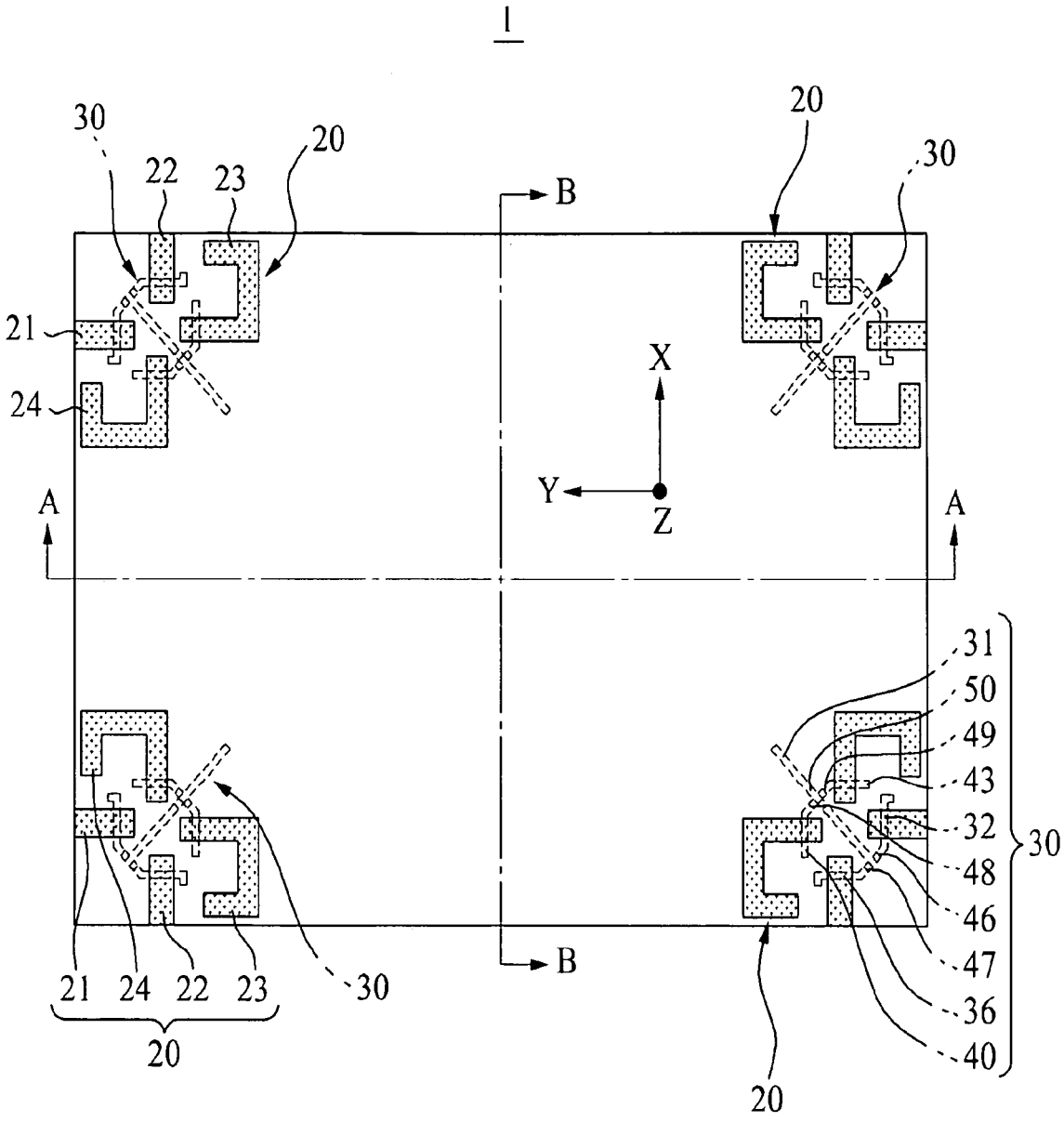
FIG. 1 is a diagram illustrating an example of a top view of an antenna apparatus.
Figure 2:
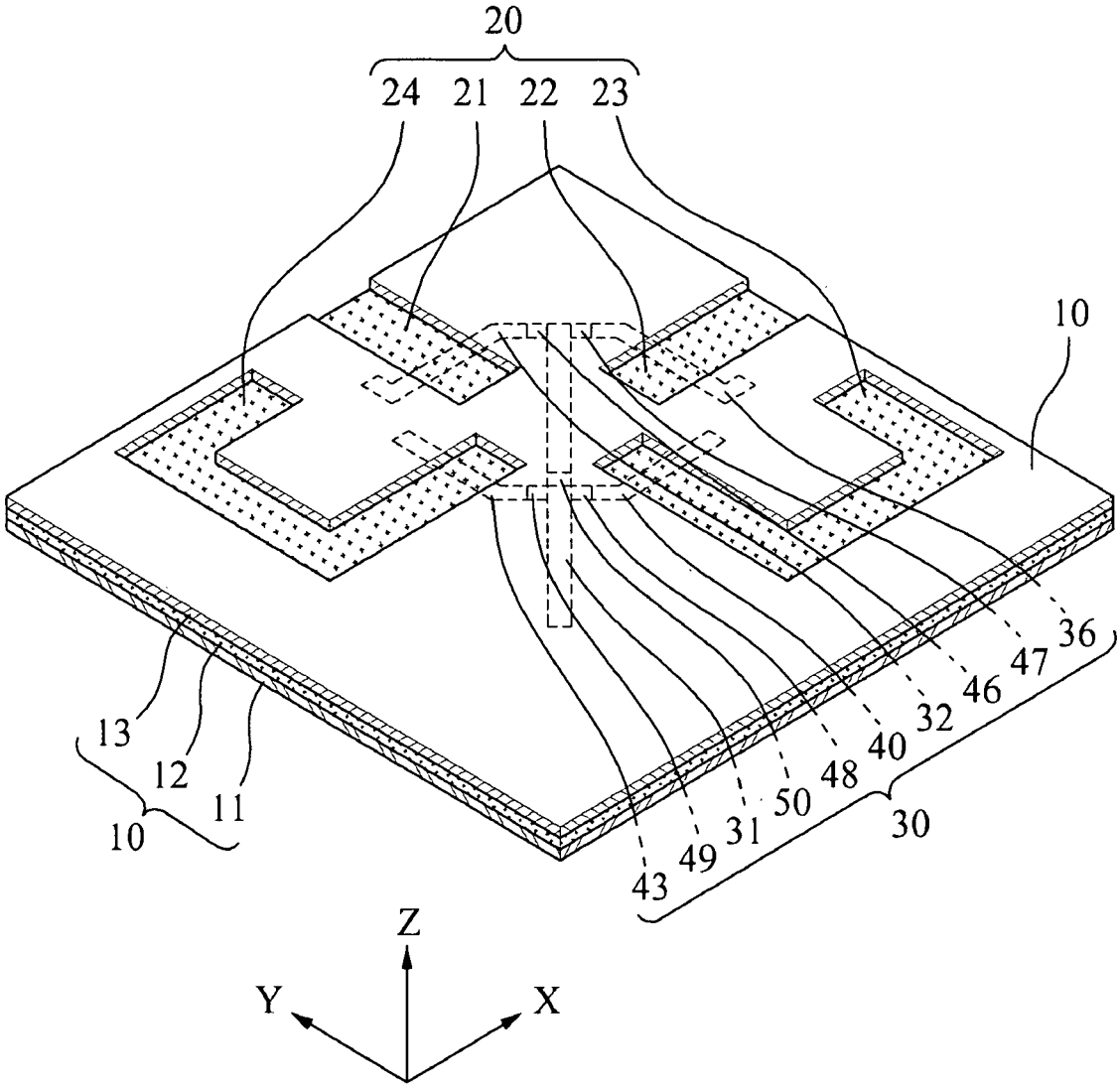
FIG. 2 is a diagram illustrating a perspective view of a portion P of the antenna apparatus of FIG. 1.
Figure 3:
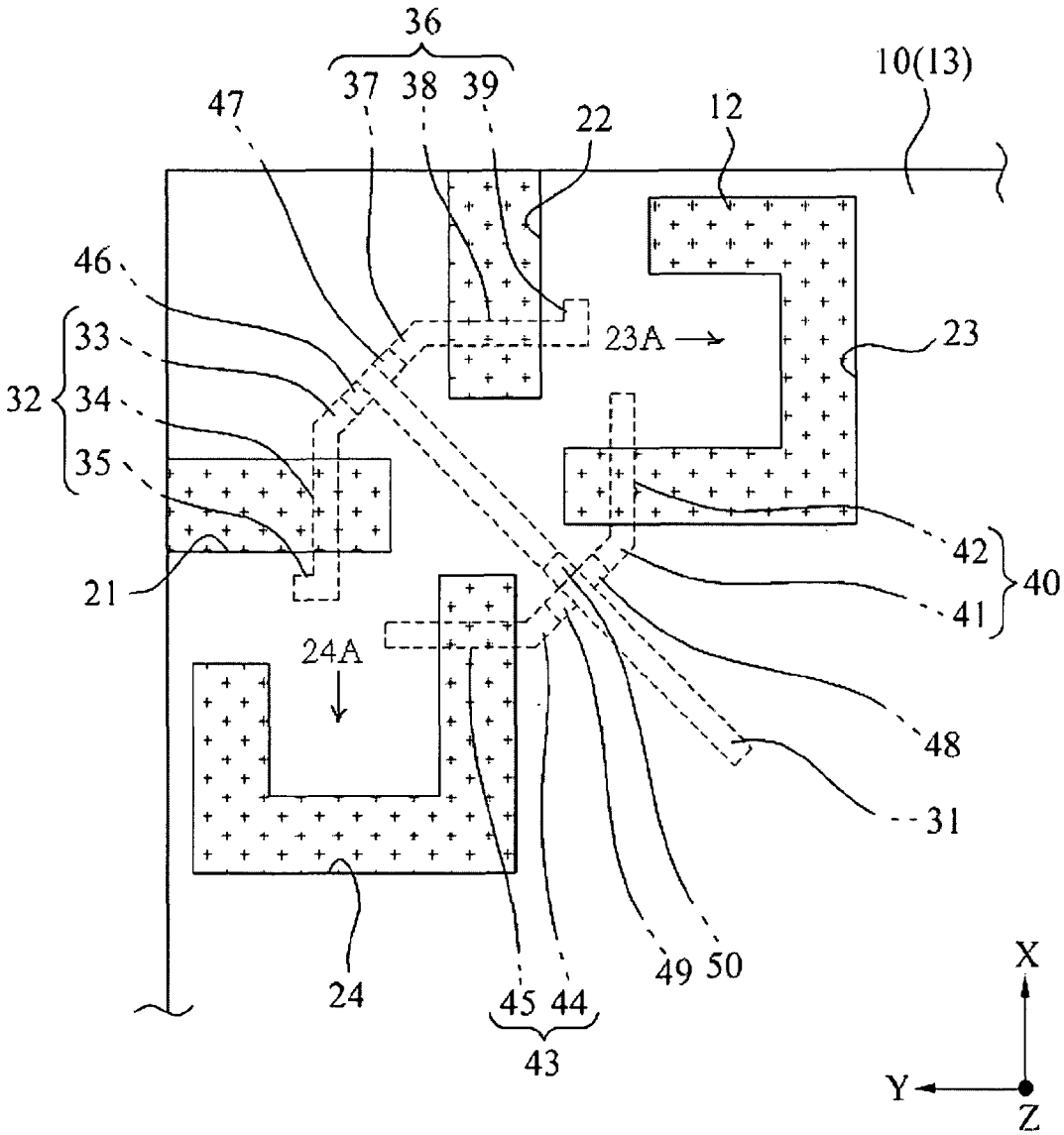
FIG. 3 is a diagram illustrating a top view of the portion P of the antenna apparatus of FIG. 1.

FIG. 1 is a diagram illustrating an example of a top view of an antenna apparatus 1. FIG. 2 is a diagram illustrating a perspective view of a portion P of the antenna apparatus 1. FIG. 3 is a diagram illustrating a top view of the portion P of the antenna apparatus 1. The antenna apparatus 1 includes a substrate 10, at least one radiation unit 20, and at least one switch unit 30. The substrate 10 may control the radiation unit 20 and the switch unit 30, which will be described in detail later.

As illustrated in FIG. 2, the substrate 10 may include a feeding layer 11, in which the switch unit 30 may be formed; a dielectric layer 12, which may be layered on the feeding layer 11; and a ground layer 13, in which the radiation unit 20 may be formed. The substrate 10 may be shaped as a rectangular plate, as shown in FIGS. 1-3; however, the substrate is not limited to a rectangular shape and also may be a polygonal or a circular shaped plate. The radiation unit 20 may be provided on the substrate 10 and may be capable of selectively transmitting and receiving information in all directions (i.e., in 360°).

The radiation unit 20 may include first through fourth radiators 21, 22, 23, and 24. FIGS. 4A, 4B, 4C and 4D are examples of graphs of main radiation patterns R1, R2, R3, and R4 of the respective first through fourth radiators 21, 22, 23, and 24. Each radiator 21, 22, 23, and 24 may be capable of forming each main radiation pattern R1, R2, R3, and R4 in different directions. For reference, the main radiation patterns R1, R2, R3, and R4, are perpendicularly formed with each other, for the purpose of transmission/reception of information in all directions of the radiation unit 20.

The ground layer 13 on the substrate 10 may be removed in a specific pattern to form a slot exposing the dielectric layer 12, thereby easily manufacturing the first through fourth radiators 21, 22, 23, and 24 and implementing a small antenna apparatus 1 with high communication performance. For purpose of reference, the substrate 10 is shown as formed in an XY plane, wherein in the X and Y axes forming the plane are perpendicular, and with a Z axis perpendicular to the XY plane of the substrate 10. The first through fourth radiators 21, 22, 23, and 24 may be asymmetrically formed with respect to predetermined X and Y axes. Due to the above described configuration, when any one radiator of the first through fourth radiators 21, 22, 23, and 24 is turned on, responsiveness to information corresponding to perpendicular and horizontal elements may be sufficiently reserved.

Figure 4A:
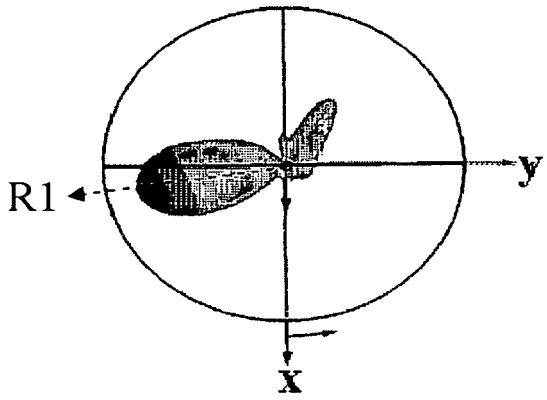
FIG. 4A is a graph illustrating an example of a main radiation pattern of a first radiator.

The first radiator 21 may expand in a straight line with a length of a ¼ wavelength of a transmission/reception radio wave. As illustrated in FIG. 3, the first radiator 21 may perpendicularly expand from a first edge of the substrate 10 near a corner of the substrate 10. As illustrated in FIG. 4A, the first radiator 21 may radiate a pattern, such as, for example, a first main emission pattern R1.

The second radiator 22 may perpendicularly expand with respect to the first radiator 21 with a length of a ¼ wavelength of a transmission/reception radio wave. In this case, the second radiator 22 may expand from a second edge of the substrate 10 adjacent to the first edge of the substrate 10 in a perpendicular straight line. As seen in FIGS. 1 through 3, the perpendicular direction of the first radiator 21 from the first edge may correspond to the Y axis and the perpendicular direction of the second radiator 22 from the second edge may correspond to the X axis.

Figure 4B:
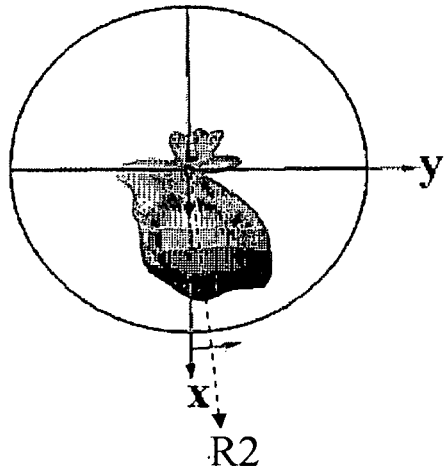
FIG. 4B is a graph illustrating an example of a main radiation pattern of a second radiator.

The second radiator 22 may radiate a pattern, such as, for example, a second main emission pattern R2 as illustrated in FIG. 4B, which is approximately perpendicular to the first main emission pattern R1. In this case, the second main emission pattern R2 may be formed at a location that is approximately 90 degrees counterclockwise from the first main emission pattern R1.

Figure 4C:
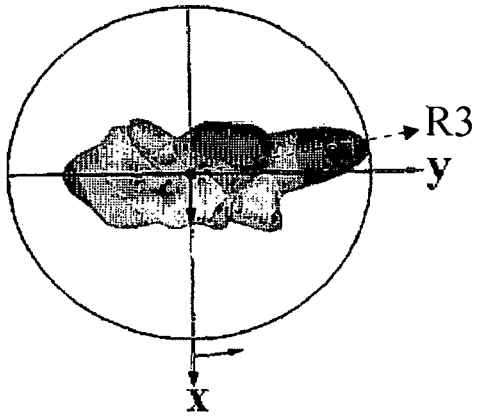
FIG. 4C is a graph illustrating an example of a main radiation pattern of a third radiator.

The third radiator 23 may include at least two bends forming generally a 'ㄷ' shape with a length being ¼ of a wavelength of a transmission/reception radio wave. The 'ㄷ' shape may include an opening portion 23A. The opening portion 23A may face and generally be orthogonal to the second radiator 22. The third radiator 23 may be bent twice and may be formed in generally a 'ㄷ' shape. The 'ㄷ' shaped opening portion 23A may face a side along the length of the second radiator 22. The third radiator 23 may form a third radiation pattern R3 which is approximately perpendicular to the second radiation pattern R2, as illustrated in FIG. 4C. Similarly, the third main radiation pattern R3 may be formed at a location separated by approximately 90 degrees in a counterclockwise direction from the second main radiation pattern R2.

Figure 4D:
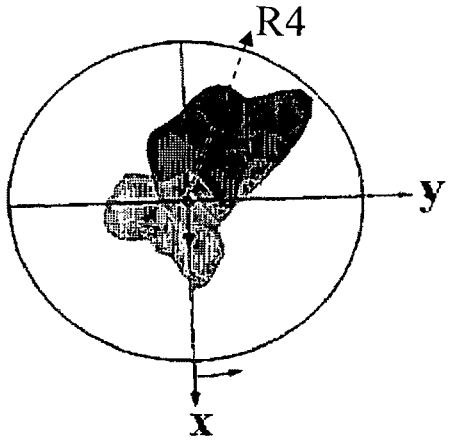
FIG. 4D is a graph illustrating an example of a main radiation pattern of a fourth radiator.

The fourth radiator 24 also may be bent twice and may be formed in generally a 'ㄷ' shape 24A with a length being ½ of a wavelength of a transmission/reception radio wave. The fourth radiator 24, similar to the third radiator 23, the 'ㄷ' shape may include an opening portion 24A that is generally orthogonal to and faces a side along the length of the first radiator 21. The fourth radiator 24 may form a fourth radiation pattern R4 which is approximately perpendicular to the third radiation pattern R3, as illustrated in FIG. 4D. For reference, the fourth radiation pattern R4 may be provided between the first and the third radiation patterns R1 and R3.

When the radiation unit 20 having the configuration described above provides the first main radiation pattern R1 of 90 degrees radiated from the first radiator 21, the second through the fourth radiation patterns R2, R3, and R4 may be formed at a location of approximately 180 degrees, 270 degrees, and 360 degrees, respectively, thereby implementing transmission/reception of information to/from all actual directions. Also, since the radiation unit 20 may be equipped with the first and second radiators 21 and 22 with the length being ¼ of a wavelength of the transmission/reception radio wave and the third and fourth radiators 23 and 24 being of bent shape with the length being ½ of a wavelength of the transmission/reception radio wave, and may be densely formed on the substrate 10, it is possible to implement the radiation unit 20 in a more compact structure. Consequently, it is possible to implement a small sized antenna apparatus with the compact radiation unit 20 employed.

As illustrated in FIG. 1, a plurality of the radiation units 20, including the first through fourth radiators 21, 22, 23, 24, may be formed on the substrate 10 to implement a MIMO antenna capable of transmitting and receiving more information at a faster speed. In this case, the radiation unit 20 may be sufficiently isolated on the substrate 10 in order to prevent interference of radiation patterns. FIG. 1 illustrates an example of the rectangular plate-shape substrate 10 and four radiation units 20 installed at each corner of the substrate 10. However, the number of radiator units 20 as shown in FIG. 1 is not limited to four.

The multiple radiator units 20 may form mirror images in a symmetrical formation to virtual guide lines A and B which may correspond to the Y axis and X axis on the substrate 10 of FIG. 1.

To form the main radiation patterns R1, R2, R3, and R4 in desired directions in response to various environments, the switch unit 30 may selectively operate the first through the fourth radiator 21, 22, 23, and 24 by turning them on and off. The switch unit 30 may include a main feeding line 31 which may be patterned on the feeding layer 11 of the substrate 10; a first through a fourth sub feeding line 32, 36, 40, 43; and a first through a fifth switch 46, 47, 48, 49, 50.

The main feeding line 31 may be connected with a control unit (not illustrated), and may transmit a signal to turn on/off at least one of the first through the fourth radiator 21, 22, 23, 24. As illustrated in FIG. 3, for example, the main feeding line 31 may be formed between the first through the fourth radiator 21, 22, 23, 24, with a specific length in a direction crossing the X and Y axes.

The first through the fourth sub feeding line 32, 36, 40, 43 may connect the main feeding line 31 to each of the first through the fourth radiator 21, 22, 23, 24, respectively. In this case, the first through the fourth sub feeding line 32, 36, 40, 43 may be separated from the main feeding line 31 and may generally extend away from the main feeding line 31 towards the first through the fourth radiator 21, 22, 23, 24.

The first through the fifth switch 46, 47, 48, 49, 50 may selectively turn on/off the connection between the main feeding line 31 and each of the first through the fourth sub feeding line 32, 36, 40, 43. In other words, the first through the fourth switch 46, 47, 48, 49 may be provided between the main feeding line 31 and the first through the fourth sub feeding line 32, 36, 40, 43, and the fifth switch 50 may be provided on the main feeding line 31 to turn on/off signal transmission to the first switch 46 and the second switch 47. However, since the fifth switch 50 may control on/off signals by distinguishing the first and the second switches 46 and 47 and the third and the fourth switches 48 and 49, a modified embodiment where the fifth switch 50 is removed and including the first through fourth switches 46, 47, 48 and 49 may also be provided.

As illustrated in FIG. 3, the first through the fourth feeding line 32, 36, 40, 43 may include a first through a fourth connection unit 33, 37, 41, 44 connected with each of the first through the fourth switch 46, 47, 48, 49, respectively, and a first through a fourth expansion unit 34, 38, 42, 45 may expand from each of the first through the fourth connection unit 33, 37, 41, 44 and perpendicularly cross the first through the fourth radiator 21, 22, 23, 24.

The first and the second expansion units 34 and 38 may be generally perpendicular to each other in the XY plane and formed across a width of the first and the second radiators 21 and 22 The third and the fourth expansion units 42 and 45 may be generally perpendicular to each other in the XY plane and formed across a width of the third and the fourth radiators 23 and 24. Further, for impedance matching of the first and the second radiators 21 and 22, which may be linear, the first and the second expansion units 34 and 38 may extend past the width of the radiator 21 and 22 and include first and the second bent ends 35 and 39, bent away from the main feeding line in the XY plane generally perpendicular to the rest of the first and second expansion units 34 and 38 generally parallel to the length of the radiators 21 and 22. Also, the 'ㄷ' shaped bent third and the fourth expansion units 42 and 45 which correspond to the third and the fourth radiators 23, and 24 may be formed in straight lines and may be symmetric with each other.

According to such configuration, during operation of the first radiator 21, the first and fifth switches 46 and 50 may be turned on, and the second, third, and fourth switches 47, 48, and 49 may be turned off. Consequently, the main feeding line 31 and the first sub feeding line 32 are electrically connected with each other so that the first radiator 21 forms the radiation pattern R1 to transmit/receive information.

In the case the second radiator 22 is exclusively operated, the second and the fifth switches 47 and 50 are turned on, and the first, third, and fourth switches 46, 48, and 49 are turned off, and the main feeding line 31 and the second sub feeding line 36 are electrically connected with each other. Also, in the case the third radiator 23 is exclusively required to be operated, the third switch 48 may be turned on, and the first, second, fourth, and fifth switches 46, 47, 49, and 50 may be turned off, and the main feeding line 31 and the third sub feeding line 40 may be electrically connected. Similarly, in case that only the fourth radiator 24 is exclusively required to be operated, the fourth switch 49 may be turned on, and the first, second, third, and fifth switches 46, 47, 48, and 50 may be turned off, the main feeding line 31 and the third sub feeding line 43 may be electrically connected with each other.

As another general example, the first, third, and fifth switches 46, 48, and 50 may be turned on and the second and the fourth switches 47 and 49 may be turned off, thereby operating the first and the third radiators 21 and 23. At least one radiator may be operated. As another option, the first through fourth radiators 21, 22, 23, and 24 may be operated by turning on all first through fifth switches 46, 47, 48, 49, and 50.

According to the above described configuration, any one of the first through fourth radiators 21, 22, 23, and 24 may be operated by the first through fifth switches 46, 47, 48, 49, and 50 to form a radiation pattern with a main radiation pattern suitable for communication environments. Further, since the first radiation pattern 21 may form a radiation pattern with the main radiation pattern R1 of FIG. 4A, the second radiation pattern 22 may form a radiation pattern with the main radiation pattern R2 of FIG. 4B, the third radiation pattern 23 may form a radiation pattern with the main radiation pattern R3 of FIG. 4C, the fourth radiation pattern 24 may form a radiation pattern with the main radiation pattern R4 of FIG. 4D, and the main radiation patterns R1, R2, R3, and R4 being radiated from the radiation unit 20 may be selected to a desired direction. Therefore, the radiation pattern from the radiation unit 20 may be appropriately re-configured, thereby continuously implementing high communication performance.

Figure 5:
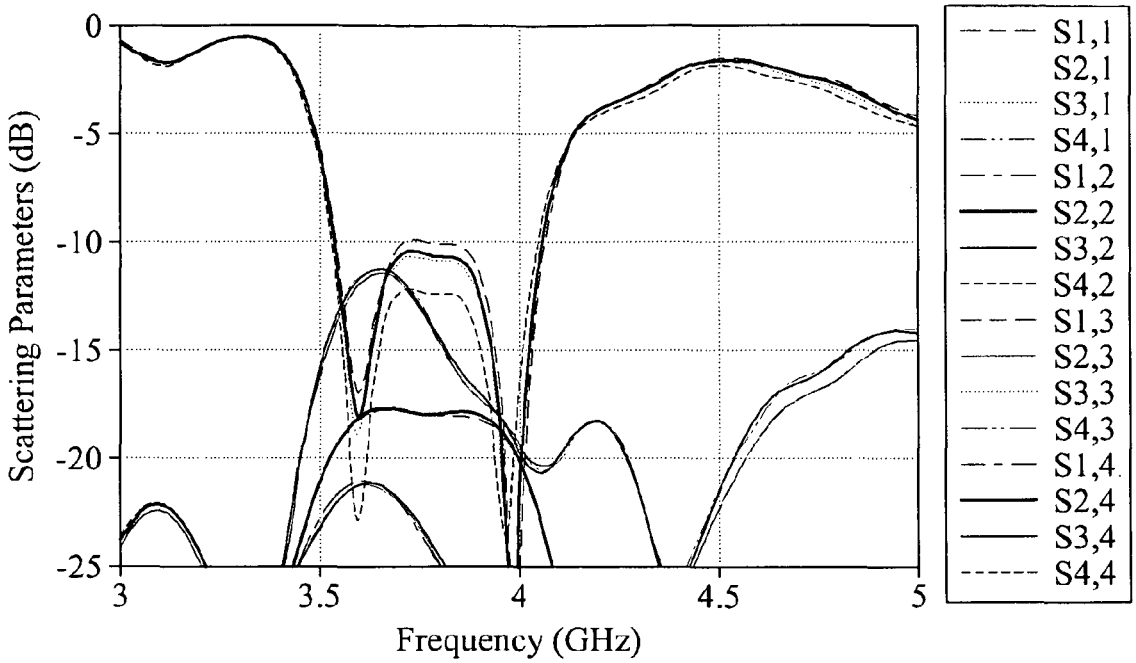
FIG. 5 is a graph illustrating an example of an approximate return loss of a plurality of radiation units.

FIG. 5 is a graph illustrating a return loss followed by first through fourth radiators 21, 22, 23, and 24 of FIGS. 1 through 3 being selectively operated. Referring to FIG. 5, the antenna apparatus 1 is operating at 3.8 GHz to cover a WiMax band. Also, a return loss value is −12 dB when a highest interference occurs between the plurality of radiation units 20, yet this return loss value is sufficiently applicable to the MIMO antenna apparatus 1.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna apparatus, comprising:

radiation units, spaced apart from each other on a substrate and configured to transmit and receive in a 360° radius, each of the radiation units comprising radiators respectively configured to radiate main emission patterns in different directions; and switch units respectively corresponding with the radiation units and configured to selectively operate the radiators of the radiation units corresponding therewith, each of the switch units comprising a main feeding line, sub feeding lines, and switches, the sub feeding lines respectively corresponding with the radiators and configured to connect the main feeding line with the radiators corresponding therewith, the switches respectively corresponding with the sub feeding lines and beingg between the main feeding line and the sub feeding lines corresponding therewith, the switches beingg configured to selectively enable connections between the main feeding line and the sub feeding lines corresponding therewith.

2. The antenna apparatus of claim 1, wherein each of the radiators is asymmetrical with respect to predetermined X and Y axes that are perpendicular with each other on a ground plane.

3. The antenna apparatus of claim 2, wherein the substrate comprises a feeding layer, a dielectric layer, and a ground layer, the feeding comprising the switch units, the switch units beingg pattern-formed therein, the dielectric layer being on the feeding layer, the ground layer beingg on the feeding layer, and wherein the radiators respectively comprise slots in which the dielectric layer is exposed.

4. The antenna apparatus of claim 3, wherein the radiators of the radiation units respectively comprise first radiators, second radiators, third radiators, and fourth radiators, the first radiators respectively comprising first slots along straight lines with lengths of a ¼ wavelength of a transmission/reception radio wave, the first radiators being configured to radiate a first main emission pattern, the second radiators respectively comprising second slots along directions perpendicular to the first radiators, the second slots respectively comprising lengths of a ¼ wavelength of the transmission/reception radio wave, the second radiators being configured to radiate a second main emission pattern that is perpendicular to the first main emission pattern, the third radiators respectively comprising third slots twice bent, the third slots respectively comprising first portions, second portions, and third portions, the first portions of the third slots respectively comprising first ends and second ends along lines respectively parallel to the lengths of the first slots, the second potions of the third slots respectively being at the first ends of the first potions of the third slots, the second portions of the third slots respectively beingg perpendicular to the first portions of the third slots, the second portions of the third slots respectively extending toward the first radiators, the third portions of the third slots respectively being at the second ends of the first portions of the third slots, the third portions of the third slots respectively being perpendicular to the first portions of the third slots, the third portions of the third slots respectively extending toward the first radiators, the third slots respectively comprising lengths of a ½ wavelength of the transmission/reception radio wave, the third radiators being configured to radiate a third main emission pattern that is perpendicular to the second main emission pattern, the fourth radiators respectively comprising fourth slots twice bent, the fourth slots respectively comprising first portions, second portions, and third portions, the first portions of the fourth slots respectively comprising first ends and second ends along lines respectively parallel to the lengths of the second slots of the second radiators, the second portions of the fourth slots respectively being at the first ends of the first portions of the fourth slots, the second portions of the fourth slots respectively beingg perpendicular to the first portions of the fourth slots, the second portions of the fourth slots respectively extending toward the second radiators, the third portions of the fourth slots respectively being at the second ends of the first portions of the fourth slots, the third portions of the fourth slots respectively being perpendicular to the first portions of the fourth slots, the third portions of the fourth slots respectively extending toward the second radiators, the fourth slots respectively comprising lengths of a ½ wavelength of the transmission/reception radio wave, the fourth radiators being configured to radiate a fourth main emission pattern that is perpendicular to the third main emission pattern.

5. The antenna apparatus of claim 4, wherein the sub feeding lines comprise four sub feeding lines, each of the four sub feeding lines configured to connect the main feeding line to a different one of the first, second, third, and fourth radiators, and wherein the switches comprise four switches, each of the four switches being between the main feeding line and a different one of the four sub feeding lines, each of the switches being configured to selectively enable its corresponding connection between the main feeding and an associated one of the four sub feeding lines.

6. The antenna apparatus of claim 5, wherein the switches further comprise a fifth switch provided on the main feeding line, the fifth switch being configured to enable signal transmission by a pair of the switches to be turned on/off.

7. The antenna apparatus of claim 5, wherein each of the sub feeding lines further comprises a connection unit and an expansion unit, the connection unit being connected with a respective one of the switches, the expansion unit extending from the connection unit and being perpendicular to a length of a respective one of the radiators.

8. The antenna apparatus of claim 1, wherein each of the switch units are spaced apart from each other on the substrate.

9. An antenna apparatus, comprising:

radiation units spaced apart from each other on a substrate and configured to selectively transmit and receive information, each of the radiation units comprising a first radiator, second radiator, a third radiator, and a fourth radiator, the first and second radiators having lengths of a ¼ wavelength of a transmission/reception radio wave, the third and fourth radiators having lengths of ½ wavelength of a transmission/reception radio wave; and switch units respectively corresponding with the first, second, third, and fourth radiators, the switch units respectively being configured to selectively enable the first, second, third, and fourth radiators to be turned on and off, each of the switch units comprising a main feeding line, sub feeding lines, and switches, the sub feeding lines respectively corresponding with the first, second, third, and fourth radiators and configured to connect the main feeding line with the first, second, third, and fourth radiators corresponding therewith the switches respectively corresponding with the sub feeding lines and being between the main feeding line and the sub feeding lines corresponding therewith, the switches being configured to selective enable connections between the main feeding line and the sub feeding lines corresponding therewith.

10. The antenna apparatus of claim 9, wherein each of the first, second, third, and fourth radiators is configured to radiate a main emission pattern that is perpendicular to a main emission pattern of adjacent radiators.

11. The antenna apparatus of claim 10, wherein the sub feeding lines comprise four sub feeding lines, each of the four sub feeding lines configured to connect the main feeding line to a different one of the first, second, third, and fourth radiators, and wherein the switches comprise four switches, each of the four switches being between the main feeding line and a different one of the four sub feeding lines, each of the switches being configured to selectively enable its corresponding connection between the main feeding and an associated one of the four sub feeding lines.

12. The antenna apparatus of claim 11, wherein the switches further comprise a fifth switch provided on the main feeding line, the fifth switch being configured to enable signal transmission by a pair of the switches to be turned on/off.

13. An antenna apparatus, comprising:

a substrate;

radiation units spaced apart from each other on the substrate, each of the radiation units comprising radiators respectively configured to radiate main emission patterns in different directions; and switch units respectively corresponding the radiation units and configured to control the main emission patterns of the radiation units corresponding therewith, each of the switch units comprising feeding line, sub feeding lines, and switches, the sub feeding lines respectively corresponding with the radiators and configured to connect the main feeding line with the radiators corresponding therewith, the switches respectively corresponding with the sub feeding lines and being between the main feeding line and the sub feeding lines corresponding therewith, the switches being configured to selectively enable connections between the main feeding line and the sub feeding lines corresponding therewith.

14. The apparatus of claim 13, wherein the radiators comprise a first radiator, a second radiator, a third radiator, and a fourth radiator configured asymmetrically with respect to predetermined X and Y axes and being perpendicular to each other on a ground plane of the substrate, and wherein each of the main emission patterns is configured to radiate from a respective one of the radiators in a direction perpendicular to a main emission pattern of adjacent radiators.

15. The apparatus of claim 14, wherein the first radiator and the second radiator each extend along a straight line having a length of ¼ wavelength of a transmission/reception radio wave, and wherein the third radiator and thHfO bradiator each include at two bends forming generally a '⊏' shape with a length of ½ wavelength of the transmission/reception radio wave.

16. The apparatus of claim 15, wherein the sub feeding lines comprise four sub feeding lines, each of the four sub feeding lines configured to connect the main feeding line to a different one of the first, second, third, and fourth radiators, and wherein the switches comprise four switches, each of the four switches being between the main feeding line and a different one of the four sub feeding lines, each of the switches being configured to selectively enable its corresponding connection between the main feeding and an associated one of the four sub feeding lines.

17. The apparatus of claim 16, wherein the switches further comprise a fifth switch provided on the main feeding line, the fifth switch being configured to enable signal transmission by a pair of the switches to be turned on/off.

18. The apparatus of claim 16, wherein each of the sub feeding lines futher comprises a connection unit and an expansion unit, the connection unit being connected to an associated one of the switches, the expansion unit extending from the connection unit and across a width of a respective one of the radiators.

19. The apparatus of claim 13, wherein:

the substrate is rectangular plate-shaped;

each of the radiation units is spaced apart from each other on respective corners of the substrate; and each of the switch units is spaced apart from each other on the respective corners of the substrate.

* * * * *